US008002282B1

(12) United States Patent
Koski

(10) Patent No.: US 8,002,282 B1
(45) Date of Patent: Aug. 23, 2011

(54) BALL GAME WITH SKIPPING IMPLEMENT AND TARGETS

(76) Inventor: Philip A. Koski, Wahkon, MN (US)

( * ) Notice: Subject to any disclaimer, the term of this patent is extended or adjusted under 35 U.S.C. 154(b) by 0 days.

(21) Appl. No.: 12/959,579

(22) Filed: Dec. 3, 2010

(51) Int. Cl.
*A63F 7/22* (2006.01)

(52) U.S. Cl. ..... 273/342; 273/317

(58) Field of Classification Search ..... 273/317, 273/342; 482/27
See application file for complete search history.

(56) References Cited

U.S. PATENT DOCUMENTS

| | | | | |
|---|---|---|---|---|
| 3,256,021 | A | 6/1966 | Nissen et al. | |
| 3,367,661 | A * | 2/1968 | Dean, Jr. | 273/374 |
| 3,368,814 | A | 2/1968 | Kolwicz | |
| 3,580,578 | A | 5/1971 | McCarthy | 273/95 R |
| 4,331,329 | A * | 5/1982 | Mirkovich et al. | 482/27 |
| 4,836,530 | A * | 6/1989 | Stanley, Jr. | 482/27 |
| 4,863,175 | A | 9/1989 | Ricks et al. | 273/342 |
| 5,201,526 | A * | 4/1993 | Ketcham, Jr. | 273/342 |
| 6,267,378 | B1 | 7/2001 | Kanbar | 273/342 |
| 6,315,677 | B1 | 11/2001 | Sandlin | 473/197 |
| 6,474,651 | B1 | 11/2002 | Rivera | 273/342 |
| 7,111,846 | B1 | 9/2006 | Breslow et al. | 273/342 |
| 7,566,060 | B1 | 7/2009 | Breslow et al. | 273/342 |
| 2005/0148433 | A1 * | 7/2005 | Wang et al. | 482/27 |

* cited by examiner

*Primary Examiner* — Raleigh W. Chiu
(74) *Attorney, Agent, or Firm* — Antonio Papageorgiou; Ostrow Kaufman LLP

(57) ABSTRACT

A ball game with skipping implement and targets comprised of a skipping implement (22) having a highly efficient rebounding and skipping surface (56) where by a player (16) can throw a ball (14) onto the skipping implement (22) redirecting the ball (14) in a multitude of directions including targeting a basket (10) for recreation and game play.

16 Claims, 3 Drawing Sheets

BALL GAME WITH SKIPPING IMPLEMENT AND TARGETS

BACKGROUND OF THE INVENTION

The present invention relates to ball games, in particular to ball games allowing the player to uniformly rebound a ball in a consistent manor.

Many ball games are in existence, which use a basket as a target. Basketball and some arcade games are representative of these types of games. Some games are played by a player throwing the ball through the air, to target the basket. Other games are played by rebounding or skipping the ball, on a surface, prior to targeting the basket. Rebounding a ball on a surface can be a joyful activity in and of itself. Surfaces vary in their ability to rebound or skip a ball. Grass, dirt, concrete, tile, water, carpet, wood and other surfaces all have different properties. These materials all have impact on a rebounded or skipped ball, thereby affecting just how much fun a rebounding or skipping activity can be.

In physics the "trampoline effect" is referred to when the pronounced elasticity of the surface affects the object impacting the surface. Trampolines get their elasticity from the springs or cords which attach the fabric to the frame. None of the surfaces mentioned above have high rebounding and skipping properties. Their properties are actually quite low and a great deal of force is required to rebound or skip a ball, if it is possible to rebound or skip a ball at all, on these surfaces. Even trampolines are not as efficient in their rebounding effects, as one may seem to believe.

Accordingly there is a need for a skipping implement which overcomes the limitations of the surfaces noted above and allows a player to uniformly rebound a ball in a consistent manor thereby accommodating the playing of ball games outdoors and indoors.

SUMMARY OF THE INVENTION

A skipping implement for a game is provided, the implement comprising a flanged cylinder having a diameter, an opening at a top of the cylinder, an opening at a bottom of the cylinder opposite the top, and a concave side; a fabric having a diameter and a pocket extending circumferentially around a perimeter of the fabric; and a cable located within the pocket of the fabric. The fabric located over the flanged cylinder so as to cover the top of the cylinder and extend over the concave side of the cylinder, the fabric secured in tension over the cylinder by cinching the cable within the pocket of the fabric.

In one embodiment the implement further comprises a band clamp located circumferentially around the concave side of the flanged cylinder, the fabric is secured further in tension over the cylinder by cinching the band clamp within the concave side of the flanged cylinder.

In one embodiment the implement further comprises a base having an upper surface, the flanged cylinder secured to the base with the bottom of the flanged cylinder against the upper surface of the base. A plurality of clamps may secure a flange of the flanged cylinder to the base.

In one embodiment the implement the fabric comprises an about 2 mm by 2 mm weave pattern.

In one embodiment the implement the flanged cylinder has a diameter of about 16 inches.

In one embodiment the implement the fabric has an overall diameter of about 21 inches.

In one embodiment the implement the game further comprises at least one basket and at least one ball.

In one embodiment the basket comprises a plurality of hoops located adjacent to each other to form a FIG. 8.

In one embodiment a first of the plurality of hoops has a first diameter larger than a diameter of another hoop of the plurality of hoops.

In one embodiment a diameter of one of the hoops is about 12 inches and a diameter of another hoop of the plurality of hoops is about 16 inches.

In one embodiment a skipping implement for a game is provided, the implement comprising: a flanged cylinder having a diameter of about 16 inches, an opening at a top of the cylinder, an opening at a bottom of the cylinder opposite the top, and a concave side; a fabric having an overall diameter of about 21 inches and a pocket extending circumferentially around a perimeter of the fabric; a cable located within the pocket of the fabric; a band clamp located circumferentially around the concave side of the flanged cylinder; and a base having an upper surface. The fabric is located over the flanged cylinder so as to cover the top of the cylinder and extend over the concave side of the cylinder, the fabric secured in tension over the cylinder by cinching the cable within the pocket of the fabric, the fabric secure further in tension over the cylinder by cinching the band clamp within the concave side of the flanged cylinder, the flanged cylinder secured to the base with the bottom of the flanged cylinder against the upper surface of the base with a plurality of clamps, the fabric comprising an about 2 mm by 2 mm weave pattern.

Additional aspects of the present invention will be apparent in view of the description which follows.

DETAILED DESCRIPTION OF THE INVENTION

Figure 1:
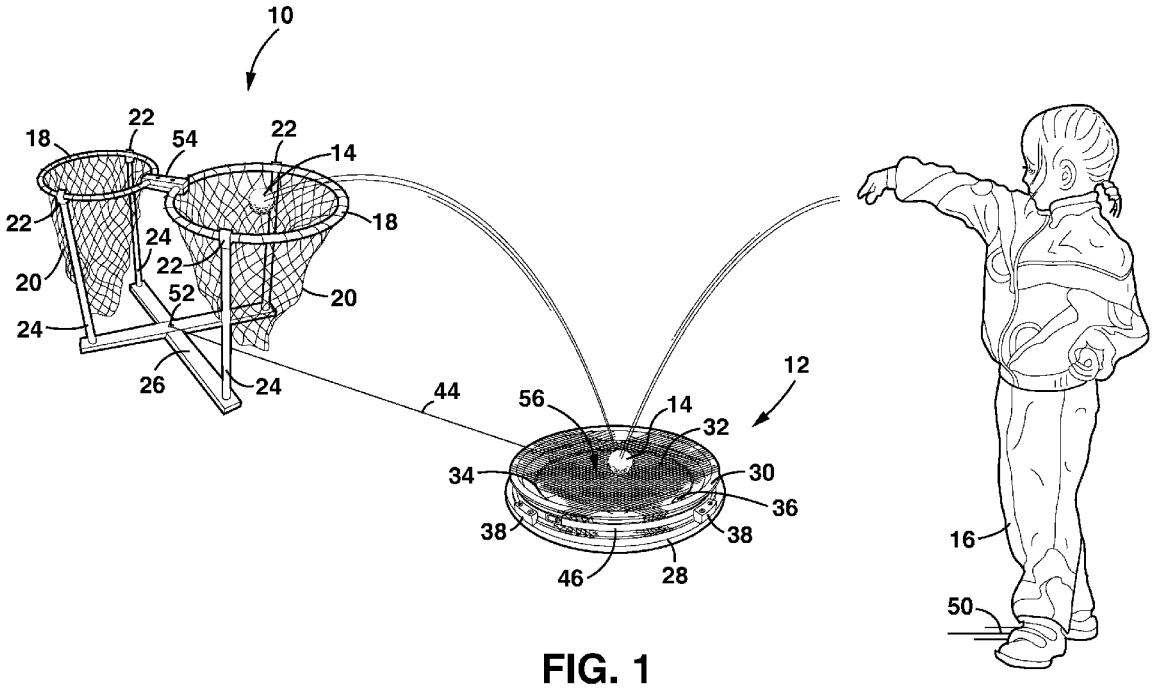
FIG. 1 is a perspective view of a ball game with a skipping implement and targets according to at least one embodiment.

FIG. 1 is a perspective view of a ball game with a skipping implement and targets according to at least one embodiment. A player 16 standing on a goal spot 50 throws a ball 14 on to the fabric 32 surface 56 of a skipping implement 12. The ball 14 is rebounded toward a basket 10. The problem of little or irregular rebound and skip is overcome by the use of the skipping implement 12 as describe herein which allows the player 16 to target basket 10 consistently and/or from greater distances.

Basket 10 is comprised of a base 26 in a crossed configuration, in the preferred embodiment. The base 26 could also be of any other shape, such as square or round. A hook 52 is located in the center of the base or at any other location and serves as a connection point for cord 44. One or more upright members 24, four in the preferred embodiment, elevate from base 26. Each upright member 24 has a clamp 22 at its top end. The purpose of the clamps 22 is to secure one or more hoops 18, two in the preferred embodiment, by friction. Hoops 18 are held together by stabilizer bar 54. The stabilizer bar 54 is comprised of one or more pieces, two in the preferred embodiment, and is secured to the hoops 18 by fasteners or other means. Nets 20 are strung from hoops 18. While the nets may or may not be present they serve contain ball 14 thrown into the nets while in play. In the preferred embodiment the top of the hoops 18 are 20 inches from the bottom of the base 26. The hoops 18 may also be set at other dimensions. The hoops 18, while they could be of any size, are 12 inches and 16 inches respectively in diameter, in the preferred embodiment.

Figure 2:
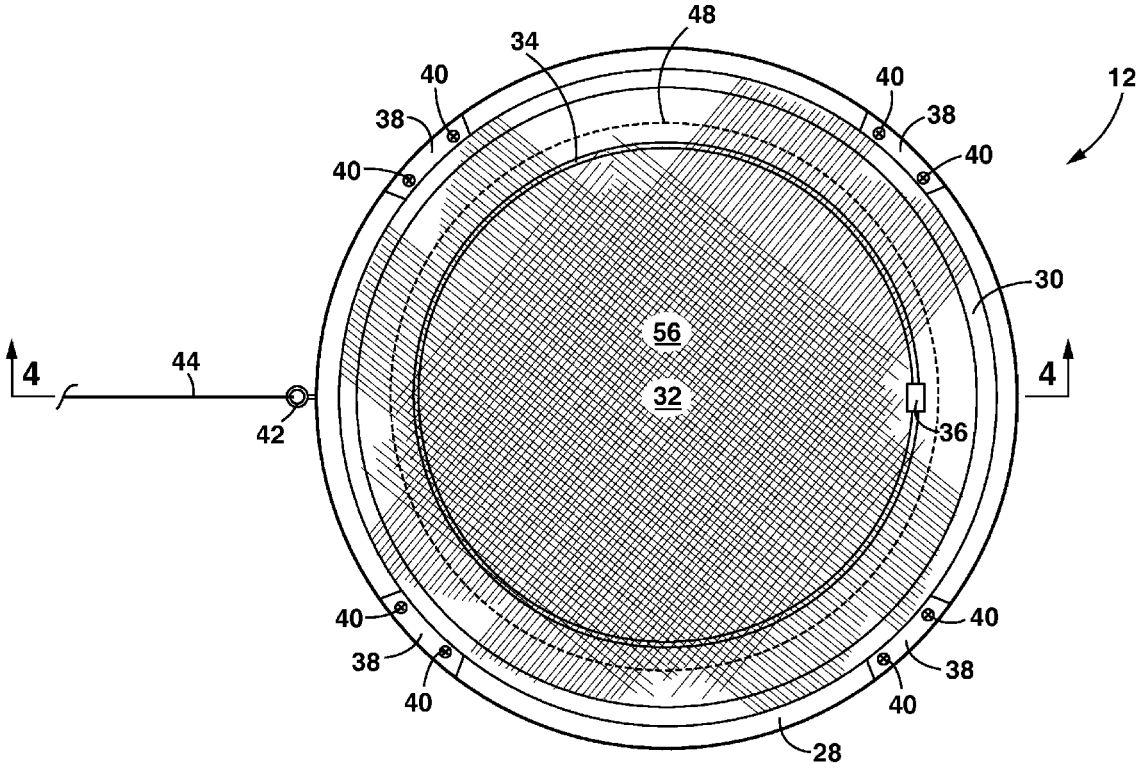
FIG. 2 is a top view of the skipping implement according to at least one embodiment.

FIG. 2 is a top view of the skipping implement 12. Skipping implement 12 includes a skipping implement base 28 which in the preferred embodiment is about 18 inches in diameter and made from a medium density fiberboard (MDF). Other dimensions and other heavier weight materials can also be used. Flange clamps 38 are secured to skipping implement base 28 by fasteners 40 and serve the purpose of holding flanged cylinder 30 in its place. An eye screw 42 or other fastening device is used to secure the measuring cord 44 to the skipping implement base 28.

The skipping implement 12 is assembled according to one embodiment in the following manor. Fabric 32 is cut to an approximate 21 inch diameter circle from a vinyl coated fabric 32 with approximately a 0.125 inch by 0.125 inch or an about 2 mm by 2 mm weave pattern. The circumference of this fabric 32 circle is then doubled back upon itself to form a pocket. Stitching 48 is sewn to close the pocket and contains an approximate 0.125 inch diameter steel or other material cable 34. The fabric 32 assembly is then placed over the flanged cylinder 30. The cable 34 is then drawn tight and secured upon itself with cable clamp 36. Then, band clamp 46 is fixed about the outer, concave side of flanged cylinder 30 and drawn tight. The whole assembly is then secured to the skipping implement base 28 in the manor described in the preceding paragraph. Thus, this assembly process forms a resilient surface 56 with the tension in the cable and the band clamp.

Figure 3:
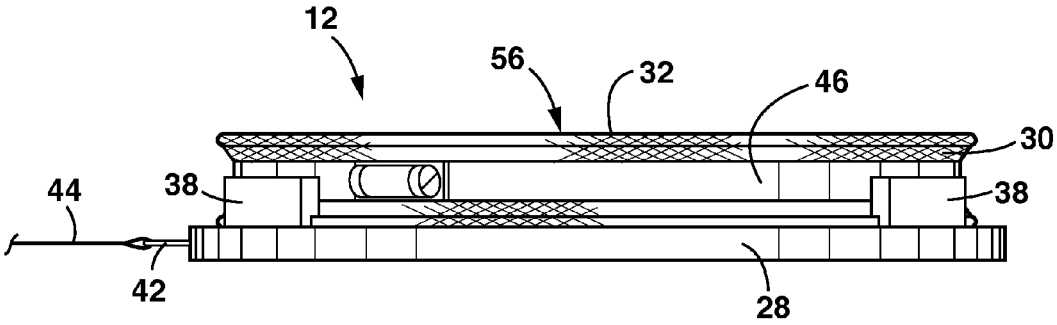
FIG. 3 is a side view of the skipping implement according to at least one embodiment.

FIG. 3 is a side view of the skipping implement 12. Further disclosed, in this view, is the assembled relationship of component parts of the skipping implement 12.

Figure 4:
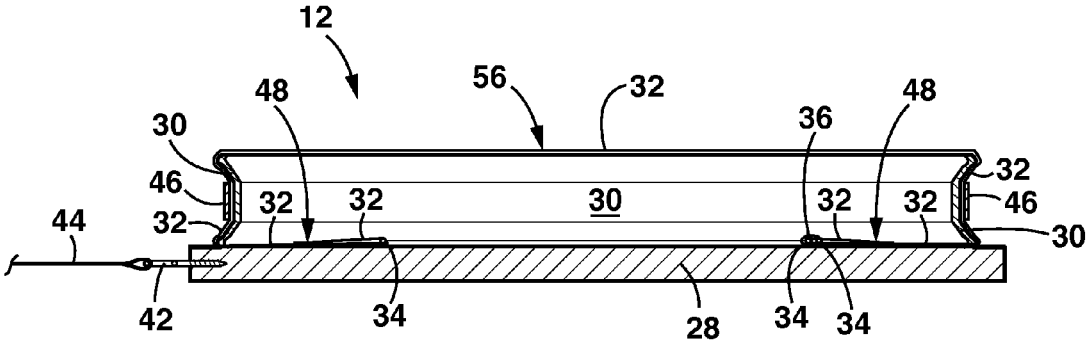
FIG. 4 is a section view from FIG. 2 according to at least one embodiment.

FIG. 4 is a section view from FIG. 2. Further disclosed, in this view, is the assembled relationship of component parts of the skipping implement 12, inclusive of the method of wrapping the fabric 32 about the flanged cylinder 30. As can be seen in this view, the cable 36 and the band clamp 46 hold the fabric 32 in the desired tension.

The surface 56 of skipping implement 12 resolves the problem other surfaces have in their ability to rebound or skip a ball 14. A golf ball 14 dropped vertically from a height of 48 inches will rebound 43 inches vertically. This is an immediate return to a height of about 86% from which the golf ball 14 was dropped. This is a highly efficient rebounding and skipping effect unachieved by other material surfaces.

The ball game with skipping implement and targets may be played as an outdoor yard game, which can readily be played indoors as well. The game can be played by someone of any age who can throw a ball 14.

The object of the game is to score points by skipping a hardball 14, (a golf ball 14 in the preferred embodiment) off of the fabric 32 surface 56 of the round, skipping implement 12, into one of two different diameter target baskets 10 suspended on upright members 24 located at a fixed distance from the skipping implement 12.

Instructions for playing the game are as follows. Locate the game on as flat a surface as possible. Set up the two circular baskets 10, with the smaller basket 10 located farthest away from the player 16. Un-wrap the cord 44 from around the skipping implement 12 and fasten the unwrapped end to the hook 52 in the center of the basket base 26. Locate the skipping implement 12 the length of the cord 44 away from, and in a straight line from the two baskets 10. The distance will be about 16 feet. Next, determine a distance for the goal spot 50 (where players will play from), directly in line with the skipping implement 12 and the baskets 10. The goal spot 50 is to be about 6 feet from the center of the skipping implement 12. The goal spot 50 can be adjusted closer or farther away to accommodate different players 16 abilities. If playing a tournament, a goal distance of 6 feet must be used by all players 16.

Game rules for two or three players 16 are as follows. Each player 16 plays individually against the other players 16. Each player 16 selects four color matched balls 14. Players 16 are to determine a final score they want to play to. (Example: 25 points). The larger diameter basket 10 will count one point. The smaller diameter basket 10 will count two points. After determining who will start, that player 16 takes a position on the goal spot 50, but not off the goal spot 50, and proceed to skip each ball 14 off the skipping implement 12 into one of the two target baskets 10. Subsequent players 16 then take their turn, thus completing the round. After completing the round, tally up the score, and recover the balls 14. Proceed to the next round of play. The players 16 are to resume the same order of play that was started with. In the event of player 16 reaches a predetermined score, and still has balls 14 remaining, the player 16 may use up the remaining balls 14, and go over the predetermined score. This will be the final round. Subsequent players 16 will do the same. The highest score wins. If there is a tie score, then a playoff round may be played to determine the winner.

Game rules for four players are as follows. Players 16 determine if they want to play individually or as a team. Two players 16 team up, and play against the other two players 16, using the total score of a team to win the game. If playing individually, the two or three player 16 rules apply. Players 16 choose four color matched balls 14.

If team play is chosen, the following rules apply. Players 16 choose four color matched balls 14. Players 16 predetermine a total score to play to. (Example: 25 or 50 points). Play begins with a player 16 from team A starting the round. Then, a player 16 from team B plays a turn. Then, back to the second player 16 on team A. Then, to the second player 16 on team B. That completes the first round. The score is tallied, and balls 14 are recovered for the next round of play with the same lineup as in round one. Play is continued until the predetermined score is reached. If after reaching the predetermined score, a player 16 still has balls remaining, they can be played beyond the predetermined score. This will be the final round. Subsequent players 16 do the same. The highest team score wins.

If in the final round both teams are tied, one player 16 from each team will play off a final round for the tiebreaker. In the event the score is still tied, the other two team members will play off to break the tie. If still tied, rotate players 16 again for another tie break round.

While the foregoing invention has been described in some detail for purposes of clarity and understanding, it will be appreciated by one skilled in the art, from a reading of the disclosure, that various changes in form and detail can be made without departing from the true scope of the invention.

REFERENCE NUMBERS

| | |
|---|---|
| 10 | basket |
| 12 | skipping implement |
| 14 | ball |
| 16 | player |

-continued

| | |
|---|---|
| 18 | hoop |
| 20 | net |
| 22 | clamp |
| 24 | upright member |
| 26 | basket base |
| 28 | skipping implement base |
| 30 | flanged cylinder |
| 32 | fabric |
| 34 | cable |
| 36 | cable clamp |
| 38 | fllange clamp |
| 40 | fastener |
| 42 | eye screw |
| 44 | cord |
| 46 | band clamp |
| 48 | stitching |
| 50 | goal spot |
| 52 | hook |
| 54 | stabilizer bar |
| 56 | surface |

What is claimed is:

1. A skipping implement for a game, the implement comprising:

a flanged cylinder having a diameter, an opening at a top of the cylinder, an opening at a bottom of the cylinder opposite the top, and a concave side;

a fabric having a diameter and a pocket extending circumferentially around a perimeter of the fabric; and a cable located within the pocket of the fabric, the fabric located over the flanged cylinder so as to cover the top of the cylinder, extend over the concave side of the cylinder, the is fabric secured in tension over the cylinder by cinching the cable within the pocket of the fabric.

2. The implement of claim 1, further comprising a band clamp located circumferentially around the concave side of the flanged cylinder, the fabric secured further in tension over the cylinder by cinching the band clamp within the concave side of the flanged cylinder.

3. The implement of claim 1, further comprising a base having an upper surface, the flanged cylinder secured to the base with the bottom of the flanged cylinder against the upper surface of the base.

4. The implement of claim 3, comprising a plurality of clamps that secure a flange of the flanged cylinder to the base.

5. The implement of claim 1, wherein the fabric comprises an about 2 mm by 2 mm weave pattern.

6. The implement of claim 1, wherein the flanged cylinder has a diameter of about 16 inches.

7. The implement of claim 1, wherein the fabric has an overall diameter of about 21 inches.

8. The implement of claim 1, the game further comprising at least one basket and at least one ball.

9. The implement of claim 8, wherein the basket comprises a plurality of hoops located adjacent to each other to form a FIG. 8.

10. The implement of claim 9, a first of the plurality of hoops having a first diameter larger than a diameter of another hoop of the plurality of hoops.

11. The implement of claim 9, wherein a diameter of one of the hoops is about 12 inches and a diameter of another hoop of the plurality of hoops is about 16 inches.

12. A skipping implement for a game, the implement comprising:

a flanged cylinder having a diameter of about 16 inches, an opening at a top of the cylinder, an opening at a bottom of the cylinder opposite the top, and a concave side;

a fabric having an overall diameter of about 21 inches and a pocket extending circumferentially around a perimeter of the fabric;

a cable located within the pocket of the fabric; and a band clamp located circumferentially around the concave side of the flanged cylinder; and a base having an upper surface; the fabric located over the flanged cylinder so as to cover the top of the cylinder, extend over the concave side of the cylinder, the fabric secured in tension over the cylinder by cinching the cable within the pocket of the fabric, the fabric is secured further in tension over the cylinder by cinching the band clamp within the concave side of the flanged cylinder, the flanged cylinder secured to the base with the bottom of the flanged cylinder against the upper surface of the base with a plurality of clamps, the fabric comprising an about 2 mm by 2 mm weave pattern.

13. The implement of claim 12, the game further comprising at least one basket and at least one ball.

14. The implement of claim 13, wherein the basket comprises a plurality of hoops located adjacent to each other to form a FIG. 8.

15. The implement of claim 14, a first of the plurality of hoops having a first diameter larger than a diameter of another hoop of the plurality of hoops.

16. The implement of claim 14, wherein a diameter of one of the hoops is about 12 inches and a diameter of another hoop of the plurality of hoops is about 16 inches.

* * * * *